US012044022B2

(12) United States Patent
Smith

(10) Patent No.: US 12,044,022 B2
(45) Date of Patent: Jul. 23, 2024

(54) LOCKING PIN FOR MULTIFUNCTION SCAFFOLD

(71) Applicant: Grady F. Smith & Co., Inc., Greenville, NC (US)

(72) Inventor: Grady F. Smith, Greenville, NC (US)

(73) Assignee: GRADY F. SMITH & CO., INC., Greenville, NC (US)

( * ) Notice: Subject to any disclaimer, the term of this patent is extended or adjusted under 35 U.S.C. 154(b) by 0 days.

(21) Appl. No.: 17/716,781

(22) Filed: Apr. 8, 2022

(65) Prior Publication Data

US 2022/0325538 A1 Oct. 13, 2022

Related U.S. Application Data

(60) Provisional application No. 63/172,933, filed on Apr. 9, 2021.

(51) Int. Cl.
*E04G 5/14* (2006.01)
*E04G 7/02* (2006.01)
*E04G 1/30* (2006.01)

(52) U.S. Cl.
CPC ..... *E04G 5/14* (2013.01); *E04G 7/02* (2013.01); *E04G 2001/305* (2013.01)

(58) Field of Classification Search
CPC .... E04G 5/08; E04G 5/14; E04G 7/02; E04G 7/08; E04G 7/10; E04G 7/28; E04G 2007/285; E04G 2001/242; E04G 2001/305; E04G 1/15; E04G 1/30; Y10T 24/45796; Y10T 24/4578; B25B 5/145; F16B 5/10; F16B 5/0036; F16B 12/22;
(Continued)

(56) References Cited

U.S. PATENT DOCUMENTS 325,221 A * 8/1885 Wright ..... F16B 13/0808 24/100
720,451 A * 2/1903 Luellen ..... A44B 17/0041 24/666

(Continued)

FOREIGN PATENT DOCUMENTS

CN 206971708 U 2/2018
CN 208702110 U 4/2019

(Continued)

*Primary Examiner* — Daniel P Cahn
*Assistant Examiner* — Shiref M Mekhaeil
(74) *Attorney, Agent, or Firm* — COATS & BENNETT, PLLC

(57) ABSTRACT

A side rail assembly useful for securing a deck of a scaffold comprises a side rail configured to be supported between two ladder frames in first and second orientations. The side rail includes first and second support surfaces for supporting the deck in the first and second orientations, respectively. First and second vertically aligned slots are formed in respective opposing surfaces of the side rail. The side rail assembly further comprises a locking pin assembly comprising a shaft, a locking tab, and a biasing member to bias the locking tab into engagement with the deck and secure the deck against one of the support surfaces of the side rail depending on the orientation. The locking pin assembly is configured to be removably engaged with the first and second slots of the side rail in both the first and second orientations.

13 Claims, 8 Drawing Sheets

(58) Field of Classification Search
CPC ..... F16B 12/34; F16B 21/02; F16B 21/04; F16B 21/09
USPC ..... 182/118; 411/552
See application file for complete search history.

(56) References Cited

U.S. PATENT DOCUMENTS 1,593,945 A * 7/1926 Macklem ..... E06C 7/16 182/119
1,807,943 A * 6/1931 Sutton ..... E04G 11/12 249/47
2,525,204 A * 10/1950 Calabro ..... B27D 3/00 269/154
2,639,951 A * 5/1953 Allenbaugh ..... E04G 7/28 182/230
2,651,093 A * 9/1953 Lynch ..... F16B 5/06 24/666
2,778,087 A * 1/1957 Krueper, Jr. ..... E04G 17/0714 269/49
2,928,443 A * 3/1960 Sevachko ..... E04G 7/28 269/221
2,993,254 A * 7/1961 Larson ..... E04G 7/24 403/396
3,249,973 A * 5/1966 Seckerson ..... F16B 21/09 24/297
3,367,689 A * 2/1968 Mccarthy ..... E04G 25/06 403/107
3,429,013 A * 2/1969 Treiber ..... F16B 5/06 24/DIG. 54
3,827,110 A * 8/1974 Dzus, Sr. ..... F16B 5/10 411/348
3,968,616 A * 7/1976 Gostling ..... E04G 11/40 52/645
4,129,393 A * 12/1978 Sickler ..... E04G 7/14 403/396
4,187,929 A * 2/1980 Cyr ..... E04G 1/15 248/235
4,207,655 A * 6/1980 MacMaster ..... F16B 5/10 292/62
4,427,191 A * 1/1984 Hess ..... B27M 3/0053 269/221
4,430,838 A * 2/1984 Bains ..... F16B 5/0036 52/584.1
4,610,362 A * 9/1986 Remp ..... A47B 81/007 206/443
4,706,822 A * 11/1987 Remp, Jr. ..... B65D 85/20 206/443
4,715,095 A * 12/1987 Takahashi ..... F16B 5/065 24/297
5,099,953 A * 3/1992 Stegath ..... E04G 1/34 182/230
5,156,233 A * 10/1992 Olsen ..... E04G 21/3276 182/3
5,309,692 A * 5/1994 Hayashi ..... E04G 23/0211 52/514
5,401,354 A * 3/1995 Colucci ..... B25B 5/142 269/93
5,467,972 A * 11/1995 Lee ..... B25B 5/10 269/118
5,513,837 A * 5/1996 Osborn ..... A63C 11/04 269/127
5,688,093 A * 11/1997 Bowers ..... F16B 5/10 411/553
5,716,154 A * 2/1998 Miller ..... B62D 27/065 403/22
6,196,758 B1 * 3/2001 Scarborough ..... F16B 21/09 403/379.2
6,354,402 B1 * 3/2002 Masino ..... E04G 1/154 182/178.1
8,806,952 B1 * 8/2014 Glass ..... A63B 61/02 73/826
8,807,612 B2 * 8/2014 Hagelskjaer ..... B65D 85/62 294/67.4
8,864,100 B2 * 10/2014 Ward ..... E04G 17/04 292/164
9,663,962 B1 * 5/2017 Whittemore ..... E04G 21/24
10,131,193 B2 * 11/2018 Degenkolb ..... B60D 1/54
10,294,078 B2 * 5/2019 Minami ..... B66B 11/0253
10,472,145 B2 * 11/2019 Lu ..... B65D 61/02
11,377,864 B2 * 7/2022 MacKarvich ..... E04G 25/04
2004/0050621 A1 * 3/2004 Masino ..... E04G 1/154 182/119
2004/0188176 A1 * 9/2004 Wyse ..... E06C 1/397 182/118
2005/0191123 A1 * 9/2005 Wertz ..... H05K 7/1053 403/353
2009/0127027 A1 * 5/2009 Bird ..... E04G 7/28 182/222
2013/0248290 A1 * 9/2013 Kreller ..... E04G 7/02 182/222
2018/0179768 A1 * 6/2018 Obayashi ..... E04G 21/3204
2019/0106891 A1 * 4/2019 Jackson ..... E04G 17/18
2020/0347618 A1 * 11/2020 Behrbohm ..... E04G 5/08
2021/0010284 A1 * 1/2021 MacKarvich ..... F16B 7/105
2021/0062580 A1 3/2021 Smith
2021/0222442 A1 * 7/2021 Smith ..... E04G 1/30
2021/0277673 A1 * 9/2021 Gaiser ..... E04G 5/08
2021/0348404 A1 * 11/2021 MacKarvich ..... E04G 25/08
2022/0186507 A1 * 6/2022 Smith ..... E04G 7/28
2022/0325538 A1 10/2022 Smith
2022/0381046 A1 * 12/2022 Qiao ..... E04G 7/08
2023/0047812 A1 * 2/2023 Eckhardt ..... E06C 1/397

FOREIGN PATENT DOCUMENTS

KR 2020090001697 U 2/2009
WO 2022212490 A1 10/2022

* cited by examiner

LOCKING PIN FOR MULTIFUNCTION SCAFFOLD

RELATED APPLICATIONS

The present application claims benefit of U.S. Provisional Application 63/172,933, which was filed Apr. 9, 2021, the disclosure of which is incorporated herein by reference in its entirety.

TECHNICAL FIELD

The present disclosure relates generally to a multifunction scaffold with an adjustable height platform and, more particularly, to an improved locking pin for securing a deck of the platform.

BACKGROUND

Scaffolds traditionally allow a deck to be mounted at a desired elevation. Notably, the supporting structure often inhibits the range of elevations that can be safely supported by the scaffold in a stable fashion. For example, if the structures supporting the deck jut significantly downward, the deck may be prevented from being mounted close to the ground. Similarly, if the structures supporting the deck juts significantly upward, the deck may be prevented from being mounted as high as it might otherwise be mounted (e.g., due to clearance, or lack of stable mounting points at the desired elevation).

BRIEF DESCRIPTION OF THE FIGURES

Aspects of the present disclosure are illustrated by way of example and are not limited by the accompanying figures.

SUMMARY

Figure 1:
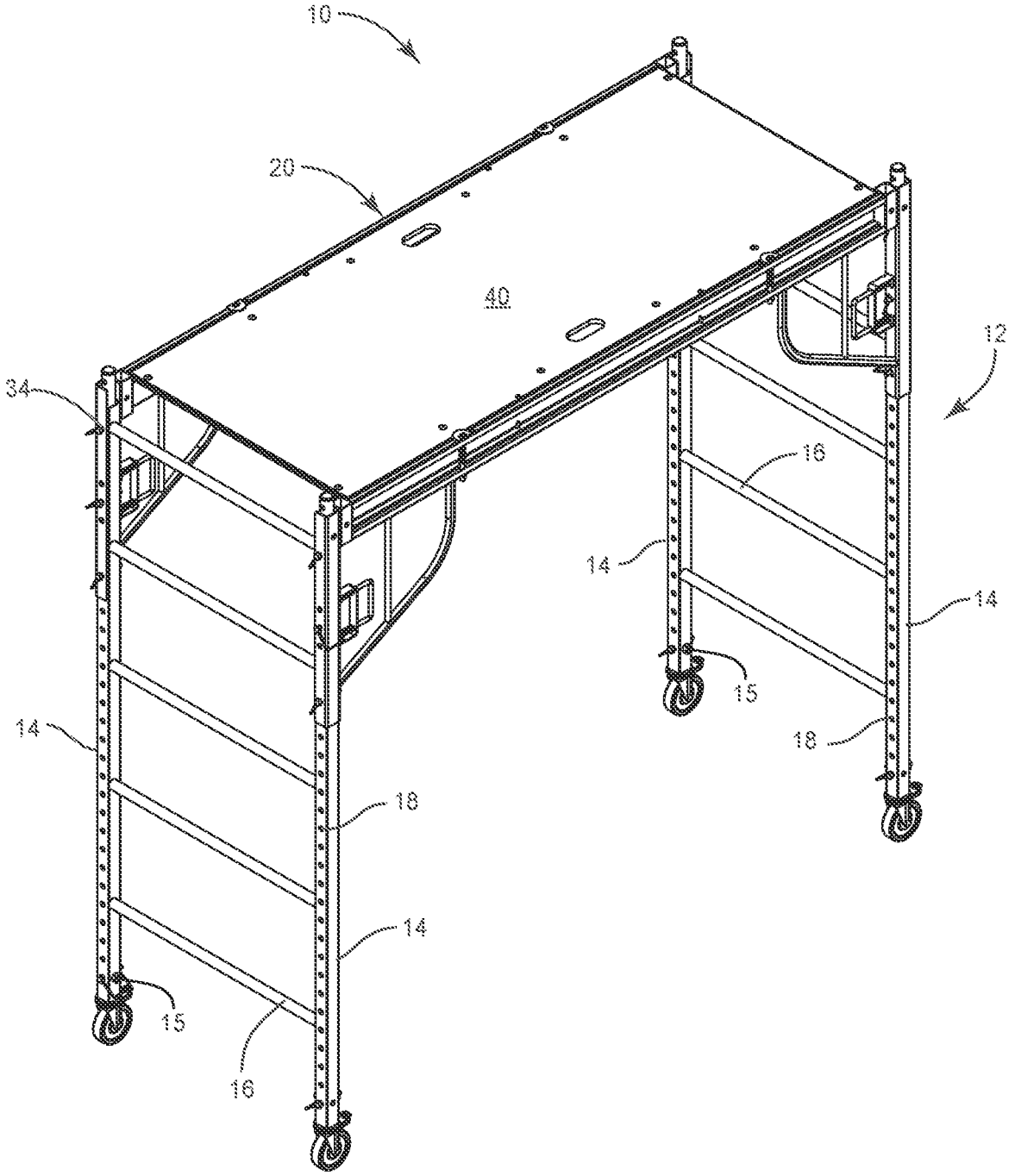
FIG. 1 is a perspective view of the multifunction scaffold with two ladder frames and an adjustable height platform.

Embodiments of the present disclosure are generally directed to a side rail assembly for a scaffold that stably and safely secures and supports a deck of the scaffold. The side rail assembly can be used to support the deck in any of a plurality of different orientations, thereby enabling (for example) selection of an orientation that best suits the task at hand. Among other things, the different orientations may collectively provide a broad range of elevation and mounting options at which the deck can be supported by the scaffold.

Particular embodiments of the present disclosure include a side rail assembly for a scaffold. The side rail assembly comprises a side rail configured to be supported between two ladder frames in first and second orientations. The side rail comprises first and second support surfaces for supporting a deck of the scaffold in the first and second orientations respectively. The side rail assembly further comprises first and second vertically aligned slots formed in respective opposing surfaces of the side rail. The side rail assembly further comprises a locking pin assembly comprising a shaft, a locking tab, and a biasing member to bias the locking tab into engagement with the deck and secure the deck against one of the support surfaces of the side rail depending on the orientation. The locking pin assembly is configured to be removably engaged with the first and second slots of the side rail in both the first and second orientations.

In some embodiments, the side rail assembly further comprises a first guide channel and a second guide channel. The side rail is disposed between the guide channels and extends along a longitudinal axis of the side rail assembly. The guide channels extend vertically away from the side rail in a first direction when the side rail is in the first orientation and in a second direction opposite to the first direction when the side rail is in the second orientation.

In some embodiments, the opposing surfaces are separated from each other by a gap, the slot of each opposing surface extending vertically through the opposing surface from an exterior of the side rail to the gap.

In some embodiments, each slot comprises a channel extending along a longitudinal axis of the side rail, a first hole that is wider than the channel, and a second hole that is spaced away from, and wider than, the first hole. Both the first hole and the second hole intersect the channel. In some such embodiments, a lower end of the shaft is configured to engage with the first hole in a lower one of the slots and an upper end of the shaft is configured to engage with the first hole in an upper one of the slots. In some such embodiments, the locking pin further comprises, toward the lower end of the shaft, a protrusion that is wider than the first hole of each of the slots. Additionally or alternatively, the biasing member comprises a coil spring disposed around the shaft of the locking pin and is arranged to bias the locking pin in a downward direction when the locking pin is installed in the side rail. In some such embodiments, the locking pin further comprises, between the lower and upper ends of the shaft, a protrusion to which the coil spring is attached. Additionally or alternatively, the coil spring coils around the shaft in a diameter wider than the first hole of each of the slots. Additionally or alternatively the second hole is configured to allow insertion of the locking pin and coil spring through the second hole in the upper slot during installation of the locking pin into the side rail. In some such embodiments, the locking pin includes a reduced diameter section spaced from the locking tab, the reduced diameter section being configured to slide within the channel during installation of the locking pin into the side rail. In some such embodiments, the shaft comprises sections above and below the reduced diameter section that are wider than the channel of each slot and narrower than the first and second holes of each slot.

In some embodiments, the locking tab includes at least one detent configured to engage within the channel of an upper one or the slots when the locking pin is installed in the side rail. In some such embodiments, the locking tab includes a flat section and the detent is configured to engage the channel with the flat of the locking tab in a first position facing towards the deck and a second position facing away from the deck.

Other embodiments include a method of securing a deck of a scaffold. The method comprises resting the deck on a support surface of a side rail of the scaffold. The side rail comprises a top slot in a top surface of the side rail and a bottom slot in a bottom surface of the side rail. The top and bottom slots are vertically aligned and the top and bottom surfaces oppose each other. Each of the slots comprises a channel, a first hole, and a second hole wider than the first hole, with the channel connecting the first and second hole. The method further comprises inserting a locking pin assembly comprising a shaft, a locking tab, a biasing member, and a reduced diameter section through both the top and bottom slots such that the biasing member passes through the second hole in the top slot and the shaft passes through the first hole in the bottom slot. The method further comprises sliding the reduced diameter section of the locking pin assembly from the second hole of the top slot, through the channel of the top slot, and over to the first hole of the top slot while keeping the shaft within the first hole in the bottom slot. The method further comprises securing the deck against the support surface with the locking pin assembly removably engaged within the first hole of the top slot and the first hole of the bottom slot with the locking tab partially overhanging the deck.

In some embodiments, the locking pin assembly further comprises a protrusion on an end of the shaft opposite the locking tab. Inserting the locking pin assembly further comprises inserting such that the protrusion is passed through the bottom slot. The method further comprises, after inserting the locking pin assembly, rotating the locking pin assembly such that the protrusion impedes the shaft from being removed from the first hole of the bottom slot.

DETAILED DESCRIPTION

FIG. 1 illustrates a multi-purpose scaffold 10 according to an exemplary embodiment. The multi-purpose scaffold 10 comprises two ladder frames 12 and an adjustable height platform 20 supported between the two ladder frames 12. The adjustable height platform 20 can be mounted between the ladder frames 12 in two different orientations depending on a height requirement for a task. The first orientation enables the platform 20 to be adjusted to its maximum height. The second orientation enables the platform 20 to be adjusted to its minimum height.

Each ladder frame 12 comprises two vertical supports 14 connected by two or more cross members 16. The vertical supports 14 and cross members 16 are preferably made of a metal tubing or other rigid tubular material. The cross members 16 are preferably welded at each end to respective ones of the vertical supports 14 so that each ladder frame 12 is a unitary structure. A series of aligned openings 18 extend through the vertical supports 14 perpendicular to the plane of the ladder frame 12 and are spaced 2 inches apart. As will be hereinafter described in more detail, the openings 18 are engaged by a releasable locking mechanism 30 on the platform 20 to secure the platform 20 at a desired height between the 42.

Figure 2:
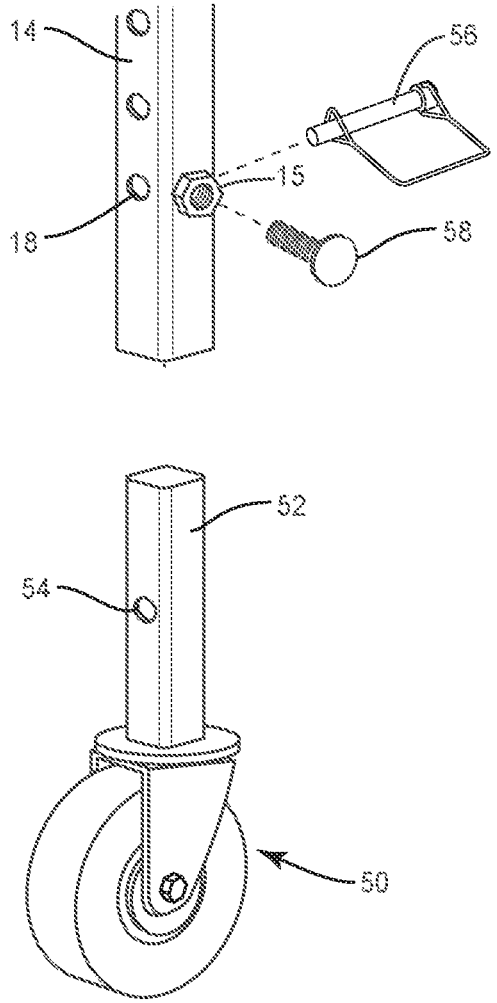
FIG. 2 is a detail view showing the attachment of a caster to the ladder frame of the scaffold.

Casters 50 or other ground-engaging members can be inserted into the lower ends of the vertical supports 14 and secured by a span pin 56 as shown in FIG. 2. The caster 50 includes a stem 52 that inserts into the end of the vertical support 14. The stem 52 includes an opening 54 that aligns with the opening 18 in the vertical support 14 to allow insertion of the span pin 56. In one embodiment, the vertical supports 14 include a nut 15 welded to the inside surface of the vertical support 14. A bolt 58 can be threadably engaged with the nut 15 and tightened against the stem 52 of the caster 50 that extends into the vertical support 14. Tightening the bolt 58 presses the stem 52 of the caster 50 against the opposing wall of the vertical support 14 and eliminates play between the caster stem 52 and vertical 14 to provide more stability.

Figure 3:
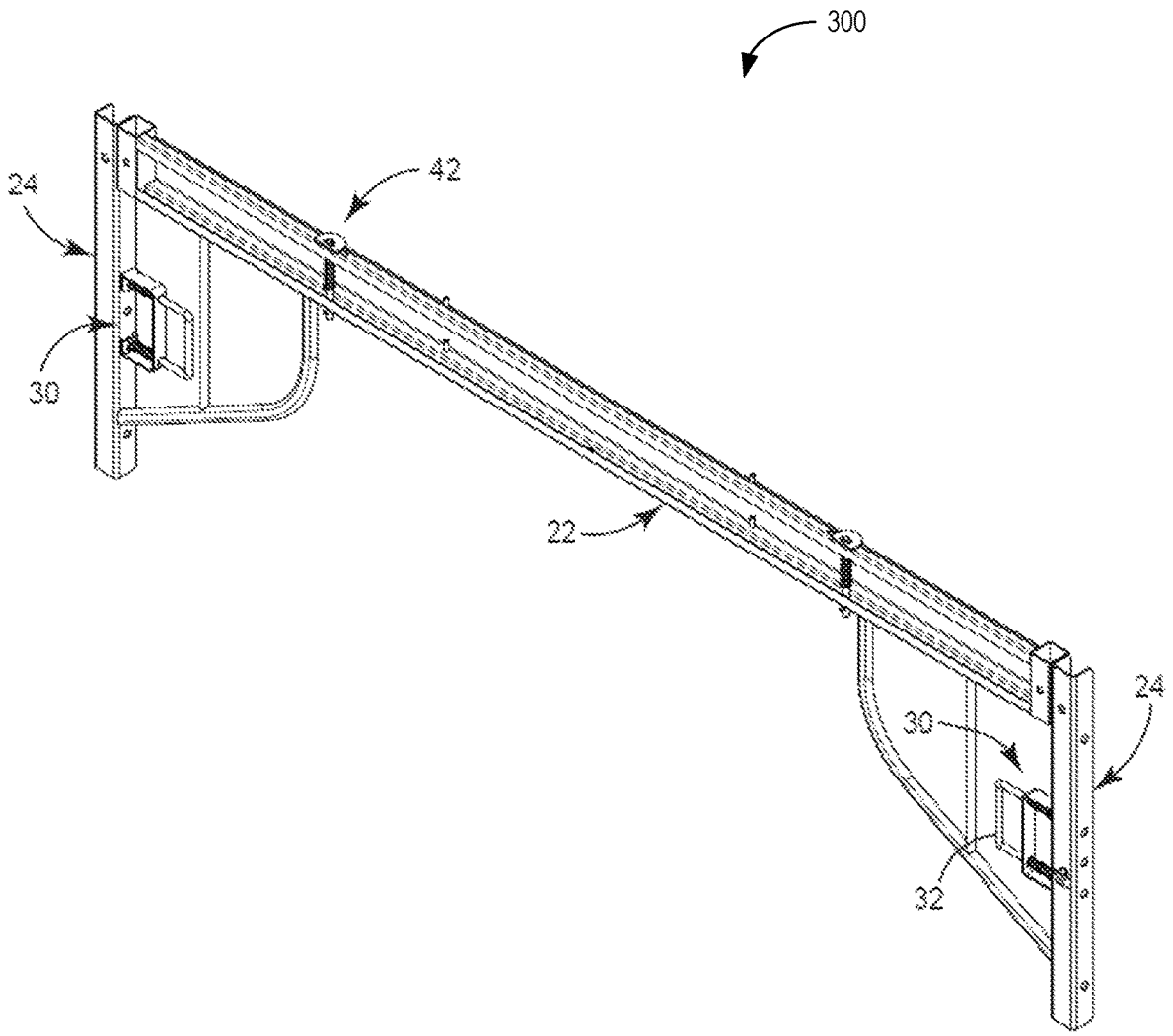
FIG. 3 illustrates one of two side rail assemblies of the adjustable height platform.

The platform 20 comprises two side rail assemblies that extend between the ladder frames 12 and a deck 40 that is supported by the side rail assemblies. An example side rail assembly 300 is shown in FIG. 3. In this example, each side rail assembly 300 comprises a side rail 22 and two guide channels 24 at opposing ends of the side rail 22. The side rails 22 are symmetrical about a horizontal plane and configured to provide a support surface **22*a* for the deck 40 of the platform 20 in both a first orientation (guide channels 24 extending down from side rail 22 as shown in FIGS. 1 and 3) and a second orientation (guide channels 24 extending up from side rail 22). The platform 20 can be used in either orientation. The ability to reverse the platform 20 extends the range of adjustment, increases the maximum height and decreases the minimum height. The maximum height may be above the top of the ladder frame 12. When the platform 20 is elevated above the top of the ladder frame 12, the guide channel 24** of the side rail assembly should be clamped by means of a cuff clamp (not shown).

The guide channels 24 comprises a C-shaped channels 24 and are configured to slide along the vertical supports 14 of the ladder frames 12 at each end of the scaffold 10 to adjust the height of the platform 20. Each guide channel 24 includes a releasable locking mechanism 30 for locking the platform 20 at a desired height. In one embodiment, the releasable locking mechanism 30 comprises a U-shaped locking pin 32 that engages with the aligned openings and in the guide channel 24 and vertical supports 14 respectively to lock the side rail 22 at a desired height. The U-shaped locking pin 32 is biased by springs to an engaged position. To adjust the height of the platform, the locking pin is pulled back to disengage the locking pin from the holes 18 in the vertical supports 14. Once disengaged, the platform 20 can be adjusted in height to any desired position in the adjustment range. When the platform 20 is adjusted to the desired height, span pins 34 can be inserted through holes in the guide channel 24 that align with the holes 18 in the vertical supports 14 as a failsafe. The span pins 34 secure the platform 20 at the desired height even if the releasable locking mechanism fails or disengages.

Figure 4:
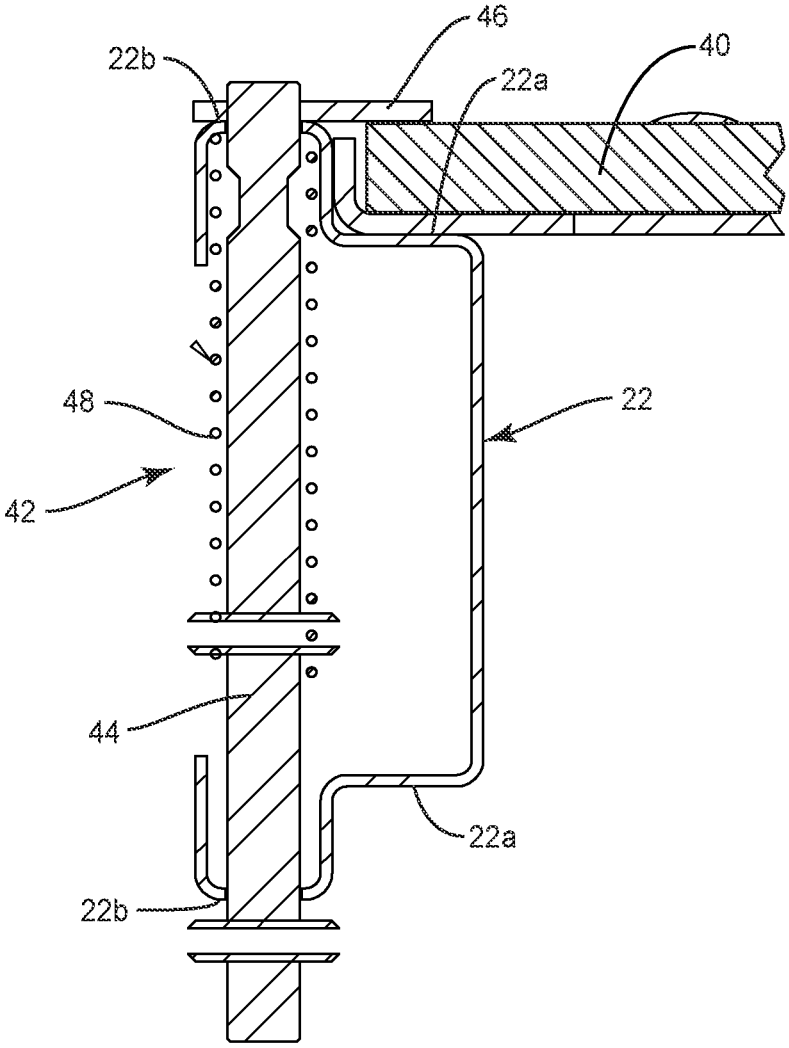
FIG. 4 is a partial section view of the adjustable height platform.

The side rails 22 are equipped with removable locking pins 42 to hold the deck 40 down once the deck 40 is put in place. FIG. 4 shows the side rails 22 with the deck 40 and locking pins 42 installed. The installation of the locking pin 42 is the same in both orientations of the platform 20.

Figure 5:
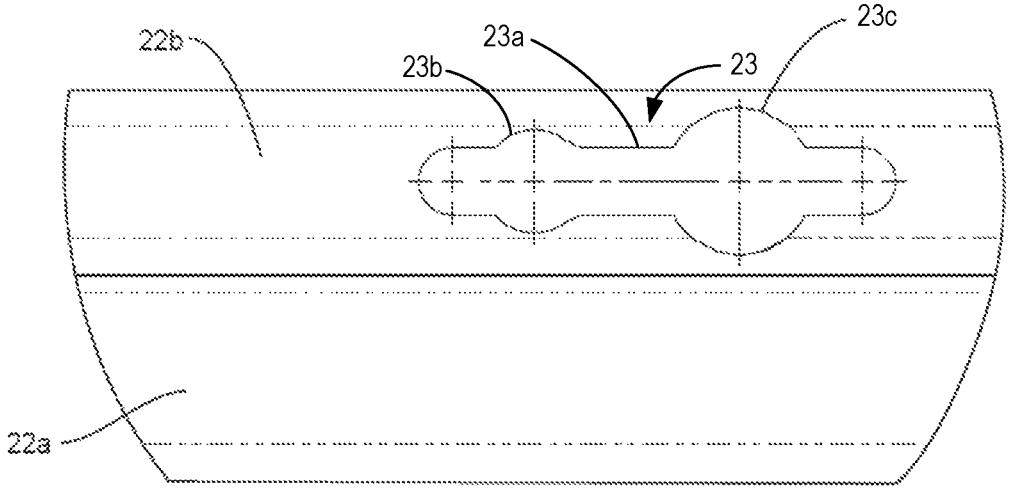
FIG. 5 is a partial top elevation showing the configuration of the slots in the side rails of the adjustable height platform.

As shown in FIG. 5, specially formed slots 23 are formed in the outer surfaces **22*b* of the side rail 22. The slots 23 in the outer surfaces 22*b* are vertically aligned. As explained in more detail below, the locking pins 42 can be installed in the vertically aligned slots 23 in both the first and second orientations. The slots 23 each include a channel 23*a*, depicted in FIG. 5 as an elongated narrow section of the slot 23. The slots 23 each also include a large hole 23*c* formed near one end of the channel 23*a* and a smaller hole 23*b* formed near the opposing end of the channel 23*a*. The holes 23*b*, 23*c* located along the length of the channel 23*a* facilitate installation of the locking pin 42 as herein described. When a need arises to reverse the platform 20, the locking pins 42** can be removed and re-installed in the new orientation without use of any tools. This eliminates the need to have separate latch mechanisms for use in each orientation.

Figure 6:
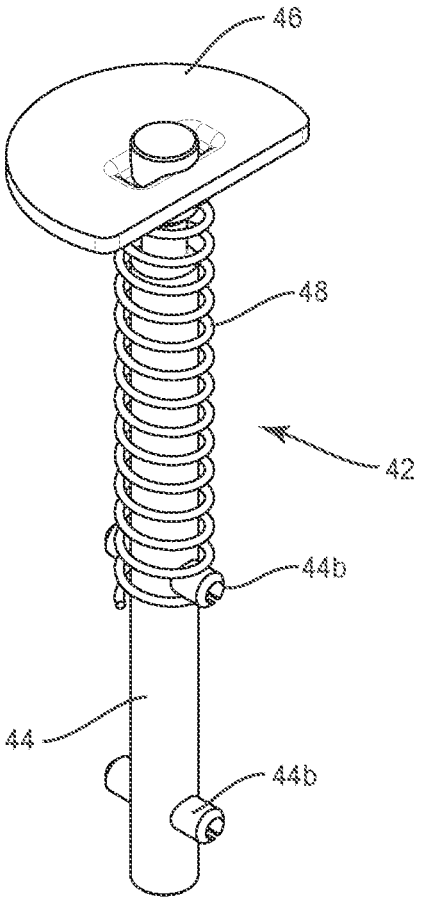
FIGS. 6 and 7 are perspective view of a locking pin for securing the deck of the adjustable height platform.
Figure 7:
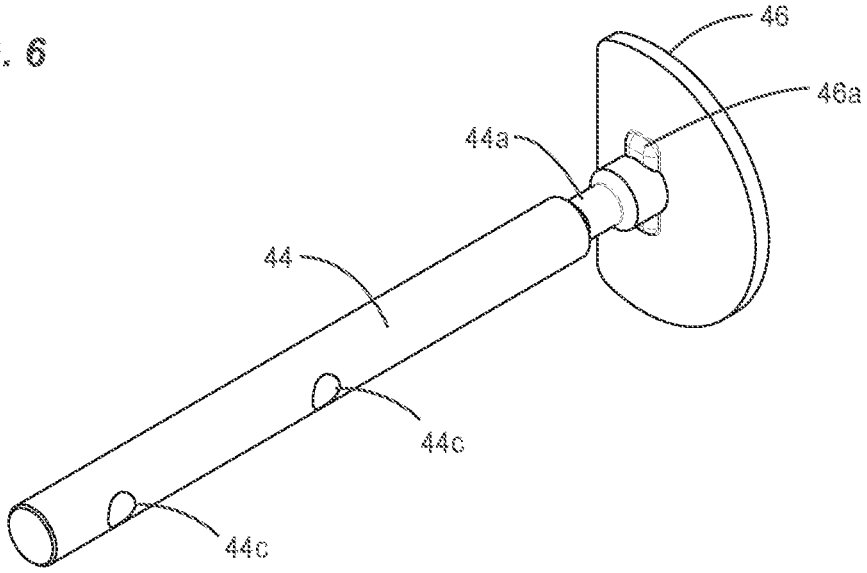

The design of an example locking pin 42 is shown in FIGS. 6 and 7. The locking pin 42 comprises a shaft 44 and a locking tab 46 that is press fit and/or spot welded onto one end of the shaft 44. The shaft 44 includes a reduced diameter section 44*a* near the end on which the locking tab 46 is installed and a pair of spaced opening 44*c* to receive respective roll pins 44*b*, each of which forms one or more protrusions on the shaft 44. The locking tab 46 has a generally circular shape with a flat on one side, i.e. a D-shape. Additionally, the locking tab 46 includes integral detents formed by stamping on the underside thereof to engage in the slots 23 as hereinafter described. When the locking pin 42 is installed, a biasing member (e.g., a coil spring 48 in the examples of FIGS. 6 and 7) biases the locking tab into engagement with the deck 40 to secure the deck 40 to the platform and to prevent the deck 40 from lifting off the support surface 22*a*. The spring 48 bears at one end on the inside of the side rail 22 and at the other end on a pin 44*b*. The spring can be ground and closed to keep the starting coil at top from accidentally threading itself up through smaller hole 23*b* in the slot 23 when the locking pin is installed.

Figure 8:
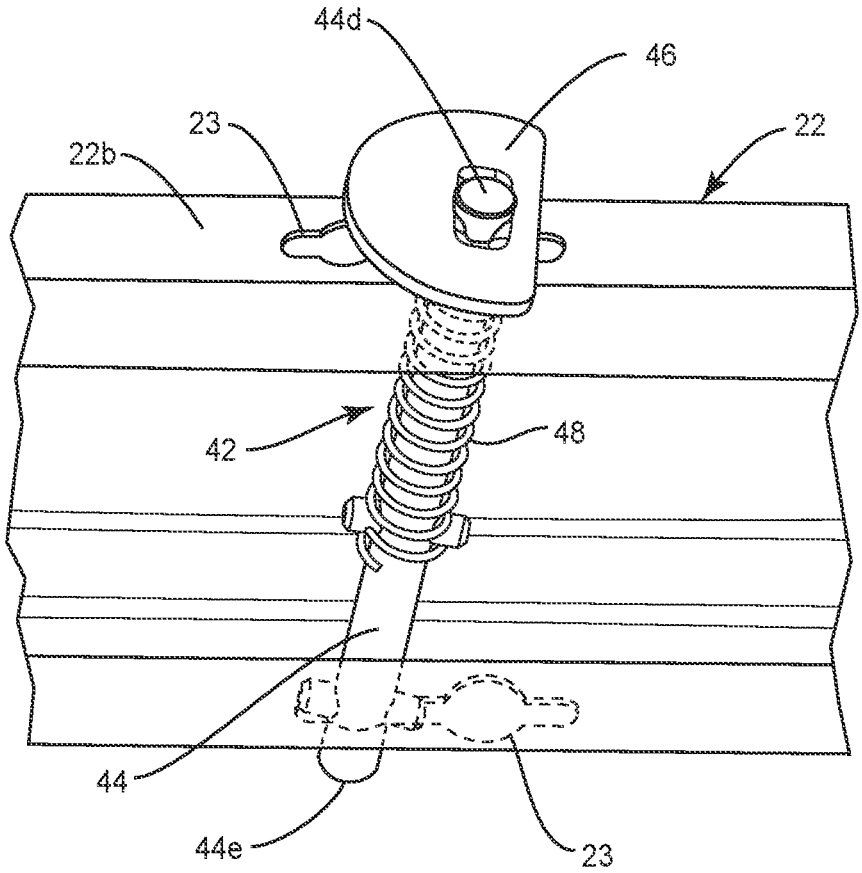
FIG. 8 is a partial perspective view illustrating the installation of the locking pin.

FIG. 8 is a perspective illustrating how a locking pin 42 is installed. No tools are required to remove and install the locking pin. The locking pin 42 is installed by inserting it at an angle through vertically aligned upper and lower slots 23 as shown in FIG. 8 and then sliding the upper end of the locking pin 42 along the upper slot 23. The shaft 44 is inserted at an angle through the large hole in the upper slot 23, which is sized to allow the shaft 44 and spring 48 to pass through the slot 23, with the lower end passing through the smaller hole in the lower slot 23. After the locking pin 42 is inserted at an angle, the locking pin 42 is rotated to the position shown in FIG. 4 so that the roll pin 44*b* in the lower end of the shaft 44 prevents withdrawal of the locking pin 42. The locking pin 42 is pushed up slightly to compress the spring 48. The roll pin 44*b* in the lower end of the shaft 44 limits the upward movement of the locking pin 42 but the location should provide enough room to align the reduced diameter section 44*a* with the upper slot 23. When the reduced diameter section 44*a* is aligned with the upper slot 23, the reduced diameter section 44*a* can slide along the narrow section of the slot 23 until the shaft 42 is vertically aligned in the smaller set of holes in the slots 23. In this way, the upper end 44*d* of the shaft 44 is moved away from the larger hole 23*c* of the upper slot 23 over toward the smaller hole 23*b* of the upper slot 23, while the lower end 44*e* of the shaft remains in the smaller hole 23*b* of the lower slot 23. When the force compressing the spring 48 is removed, the spring 48 pushes the locking tab 46 down to engage the detents 46*a* of the locking tab 46 in the slots 23 to prevent rotation of the locking pin 42.

To install the deck 40, the locking pin 42 can be pushed up slightly to rotate the locking pin 42 so that the flat of the locking tab 46 faces the deck 40. Once the deck 40 is put into place, the locking pin 42 is rotated back 180 degrees so that the curved side extends over the top of the deck 40. Even if the locking pin 42 is accidentally kicked and rotated, the deck 40 will be held in place unless the locking pin is rotated a full 180 degrees, thus providing a higher degree of safety than conventional designs currently in use. The shape of the locking tab 46 reduces the risk of kicking and accidentally disengaging the locking tab 46. Additionally, in some embodiments, a countersink can be provided in the top surface of the deck 40 where it is engaged by the locking tab 46 so that the locking tab is flush with or below the top surface of the deck 40. Providing a counter-sink in the deck 40 reduces the tripping hazard and further reduces the likelihood that the locking tab 46 will be accidentally kicked and disengaged.

Figure 9:
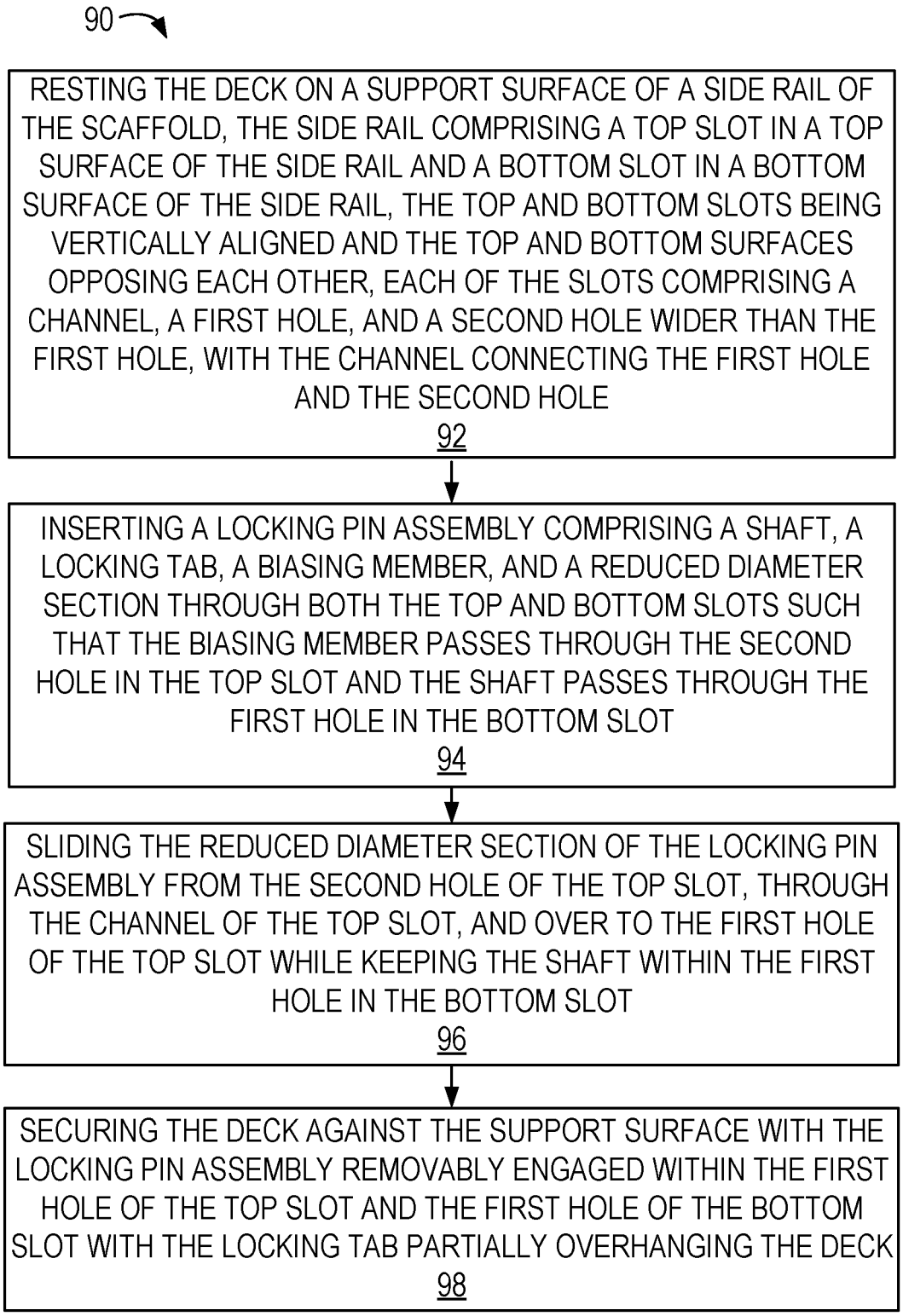
FIG. 9 is a flow diagram illustrating a method of securing a deck of a scaffold, according to one or more embodiments of the present disclosure.

FIG. 9 is a flow diagram illustrating a method 90 of securing the deck 40 the scaffold 10, consistent with one or more examples discussed above. The method 90 comprises resting the deck 40 on a support surface 22*a* of a side rail 22 of the scaffold 10 (block 92). The side rail 22 comprises a top slot 23 in a top surface of the side rail 22 and a bottom slot 23 in a bottom surface of the side rail. The top and bottom slots 23 are vertically aligned and the top and bottom surfaces 22*b* oppose each other. Each of the slots 23 comprise a channel 23*a*, a first hole 23*b*, and a second hole 23*c* wider than the first hole 23*b*, with the channel 23*a* connecting the first hole 23*b* and the second hole 23*c*.

The method 90 further comprises inserting a locking pin assembly 42 comprising a shaft 44, a locking tab 46, a biasing member 48, and a reduced diameter section 44*a* through both the top and bottom slots 23 such that the biasing member 48 passes through the second hole 23*c* in the top slot 23 and the shaft 44 passes through the first hole 23*b* in the bottom slot 23 (block 94).

The method 90 further comprises sliding the reduced diameter section 44*a* of the locking pin assembly 42 from the second hole 23*c* of the top slot 23, through the channel 23*a* of the top slot 23 and over to the first hole 23*b* of the top slot 23 while keeping the shaft 44 within the first hole 23*b* in the bottom slot 23 (block 96).

The method 90 further comprises securing the deck 40 against the support surface 22*a* with the locking pin assembly 42 removably engaged within the first hole 23*b* of the top slot 23 and the first hole 23*b* of the bottom slot 23 with the locking tab 46 partially overhanging the deck 40 (block 98).

In some embodiments, the method 90 further comprises, after inserting the locking pin assembly 42, rotating the locking pin assembly 42 such that a protrusion 44*b* impedes the shaft 44 from being removed from the first hole 23*b* of the bottom slot 23.

What is claimed is:

1. A side rail assembly for a scaffold, the side rail assembly comprising:

a side rail configured to be supported between two ladder frames in first and second orientations, the side rail comprising first and second support surfaces for supporting a deck of the scaffold in the first and second orientations respectively;

first and second vertically aligned slots formed in respective opposing surfaces of the side rail;

a locking pin assembly comprising a shaft, a locking tab, and a biasing member to bias the locking tab into engagement with the deck and secure the deck against one of the support surfaces of the side rail depending on the orientation, wherein the locking pin assembly is configured to be removably engaged with the first and second slots of the side rail in both the first and second orientations;

a first guide channel and a second guide channel, the side rail being disposed between the guide channels and extending along a longitudinal axis of the side rail assembly, wherein the guide channels extend vertically away from the side rail:

in a first direction when the side rail is in the first orientation; and in a second direction opposite to the first direction when the side rail is in the second orientation.

2. The side rail assembly of claim 1, wherein the opposing surfaces are separated from each other by a gap, the slot of each opposing surface extending vertically through the opposing surface from an exterior of the side rail to the gap.

3. A side rail assembly for a scaffold, the side rail assembly comprising:

a side rail configured to be supported between two ladder frames in first and second orientations, the side rail comprising first and second support surfaces for supporting a deck of the scaffold in the first and second orientations respectively;

first and second vertically aligned slots formed in respective opposing surfaces of the side rail;

a locking pin assembly comprising a shaft, a locking tab, and a biasing member to bias the locking tab into engagement with the deck and secure the deck against one of the support surfaces of the side rail depending on the orientation, wherein the locking pin assembly is configured to be removably engaged with the first and second slots of the side rail in both the first and second orientations;

wherein each slot comprises:

a channel extending along a longitudinal axis of the side rail;

a first hole that is wider than the channel; and a second hole that is spaced away from, and wider than, the first hole;

wherein both the first hole and the second hole intersect the channel.

4. The side rail assembly of claim 3, wherein, a lower end of the shaft is configured to engage with the first hole in a lower one of the slots, and wherein an upper end of the shaft is configured to engage with the first hole in an upper one of the slots.

5. The side rail assembly of claim 4, wherein the locking pin further comprises, toward the lower end of the shaft, a protrusion that is wider than the first hole of each of the slots.

6. The side rail assembly of claim 4, wherein the biasing member comprises a coil spring disposed around the shaft of the locking pin and is arranged to bias the locking pin in a downward direction when the locking pin is installed in the side rail.

7. The side rail assembly of claim 6, wherein the locking pin further comprises, between the lower and upper ends of the shaft, a protrusion to which the coil spring is attached.

8. The side rail assembly of claim 6, wherein the coil spring coils around the shaft in a diameter wider than the first hole of each of the slots.

9. The side rail assembly of claim 6, wherein the second hole is configured to allow insertion of the locking pin and coil spring through the second hole in the upper slot during installation of the locking pin into the side rail.

10. The side rail assembly of claim 9, wherein the locking pin includes a reduced diameter section spaced from the locking tab, the reduced diameter section being configured to slide within the channel during installation of the locking pin into the side rail.

11. The side rail assembly of claim 10, wherein the shaft comprises sections above and below the reduced diameter section that are wider than the channel of each slot and narrower than the first and second holes of each slot.

12. The side rail assembly of claim 3, wherein the locking tab includes at least one detent configured to engage within the channel of an upper one or the slots when the locking pin is installed in the side rail.

13. The side rail assembly of claim 12, wherein:

the locking tab includes a flat section; and the detent is configured to engage the channel with the flat of the locking tab in a first position facing towards the deck and a second position facing away from the deck.

* * * * *